US007988512B2

(12) United States Patent
Lin et al.

(10) Patent No.: US 7,988,512 B2
(45) Date of Patent: Aug. 2, 2011

(54) INFLATABLE DEVICE WITH ELECTRONIC DEVICES

(75) Inventors: Joseph Lin, Torrance, CA (US); Sik-Sheung Choi, New Territories (HK)

(73) Assignee: Hydrodynamic Industrial Company Limited, Hong Kong (HK)

( * ) Notice: Subject to any disclaimer, the term of this patent is extended or adjusted under 35 U.S.C. 154(b) by 201 days.

(21) Appl. No.: 12/454,591

(22) Filed: May 20, 2009

(65) Prior Publication Data

US 2010/0297899 A1 Nov. 25, 2010

(51) Int. Cl.
*B63C 9/08* (2006.01)
*B63C 9/28* (2006.01)

(52) U.S. Cl. ..... 441/129

(58) Field of Classification Search ..... 441/40, 441/129–132, 136; 362/363; 381/393; 4/506; 601/57

See application file for complete search history.

(56) References Cited

U.S. PATENT DOCUMENTS 4,725,253 A * 2/1988 Politte ..... 441/130
6,139,382 A * 10/2000 Eschbacher et al. ..... 441/32
6,814,709 B2 * 11/2004 Schwartz et al. ..... 601/57
2006/0291217 A1 * 12/2006 Vanderschuit ..... 362/363

* cited by examiner

*Primary Examiner* — Daniel Venne
(74) *Attorney, Agent, or Firm* — Raymond Sun

(57) ABSTRACT

An inflatable device that floats on water has an inflatable body that has a hollow interior, a speaker unit removably secured to the body, a battery box removably secured to the body, and wiring that electrically connects the speaker unit with the battery box. The wiring is housed inside a tube that extends inside the hollow interior of the body and exits the body at least one exit location, the wiring including a first electrical connector that is removably coupled to the speaker unit, and a second electrical connector that is removably coupled to the battery box.

20 Claims, 10 Drawing Sheets

INFLATABLE DEVICE WITH ELECTRONIC DEVICES

BACKGROUND OF THE INVENTION

1. Field of the Invention

The present invention is directed to inflatable devices that are adapted for use in water environments, and in particular, to inflatable devices that have electronic devices incorporated therewith.

2. Description of the Prior Art

Inflatable devices such as pool floats are popular recreational products that are used at pools and beaches. These products are intended to float on the water, and some are intended to carry or support a user or other items. Many such floats are adapted to carry drinks, toys or other amusement items that the user can use while enjoying the float. Pool users often enjoy using electronic devices at the pool. Examples include boom boxes, radios, MP3 players, cell phones, and similar devices.

Unfortunately, air leaks and water leaks are serious concerns in such applications. Air leaks can be caused by ineffective sealing of the wires if the wires are to extend inside the inflatable device. Water leaks would lead to water contacting electrical components, which can be hazardous and dangerous.

Therefore, there remains a need for inflatable devices that allow electronic devices to either be used, or incorporated for use, therewith in water-based environments.

SUMMARY OF THE DISCLOSURE

To accomplish the objectives set forth above, the present invention provides an inflatable device that floats on water. The device has an inflatable body that has a hollow interior, a speaker unit removably secured to the body, a battery box removably secured to the body, and wiring that electrically connects the speaker unit with the battery box. The wiring is housed inside a tube that extends inside the hollow interior of the body and exits the body at least one exit location, the wiring including a first electrical connector that is removably coupled to the speaker unit, and a second electrical connector that is removably coupled to the battery box.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
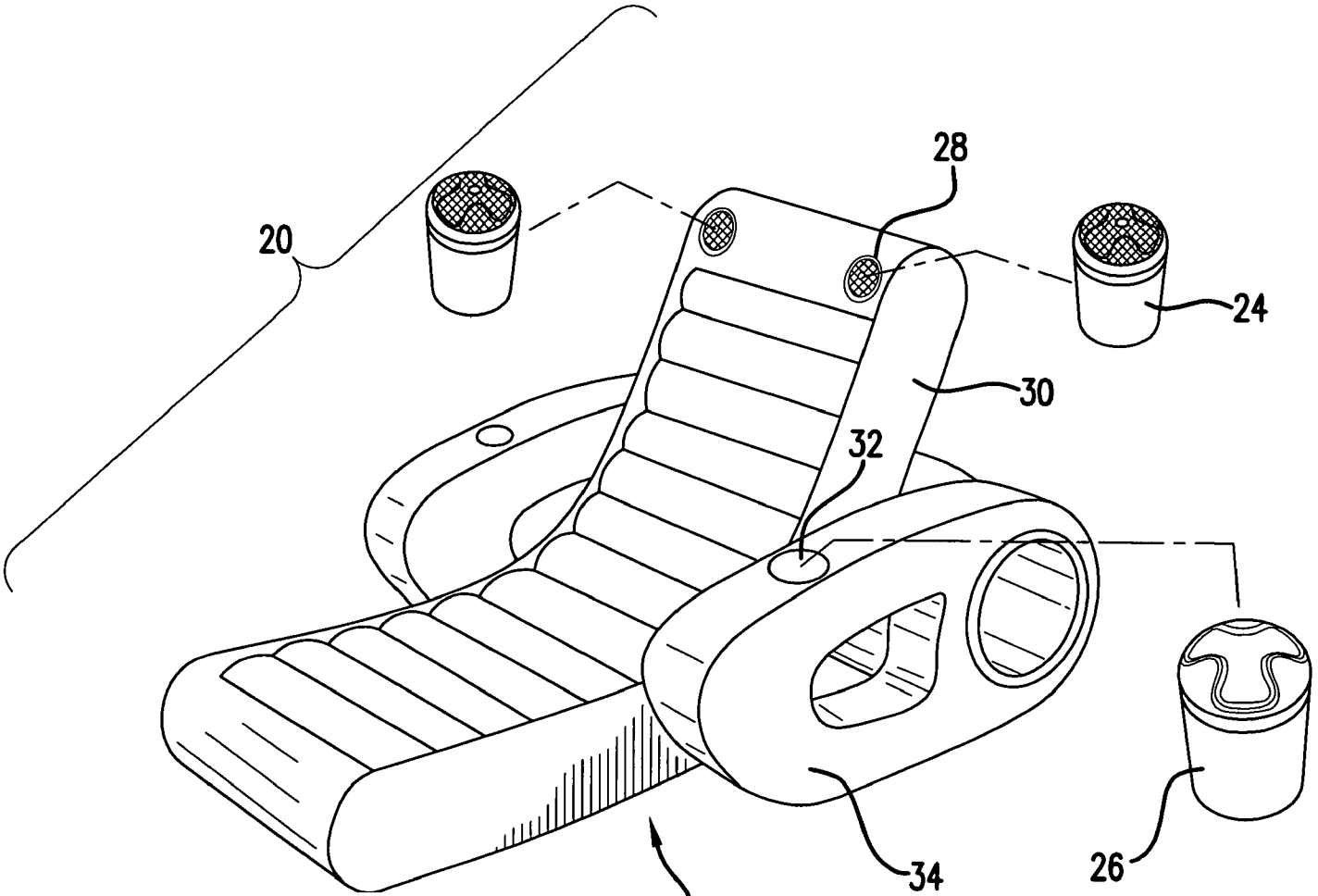
FIG. 1 is an perspective view of a pool float assembly that incorporates electronic devices according to the present invention.

FIG. 1 illustrates a pool float assembly 20 according to one embodiment of the present invention. The assembly 20 includes a conventional pool float 22, one or more speaker units 24, and an MP3 battery box 26. The pool float 22 can be the same as any conventional pool float that is available in the marketplace, and includes cavities 28 provided in the back portion 30 for receiving respective speaker units 24, and another cavity 32 in the arm rest portion 34 for receiving the MP3 battery box 26. The speaker units 24 and the MP3 battery box 26 are secured to the cavities 28, 32 in the manner described below.

Figure 2:
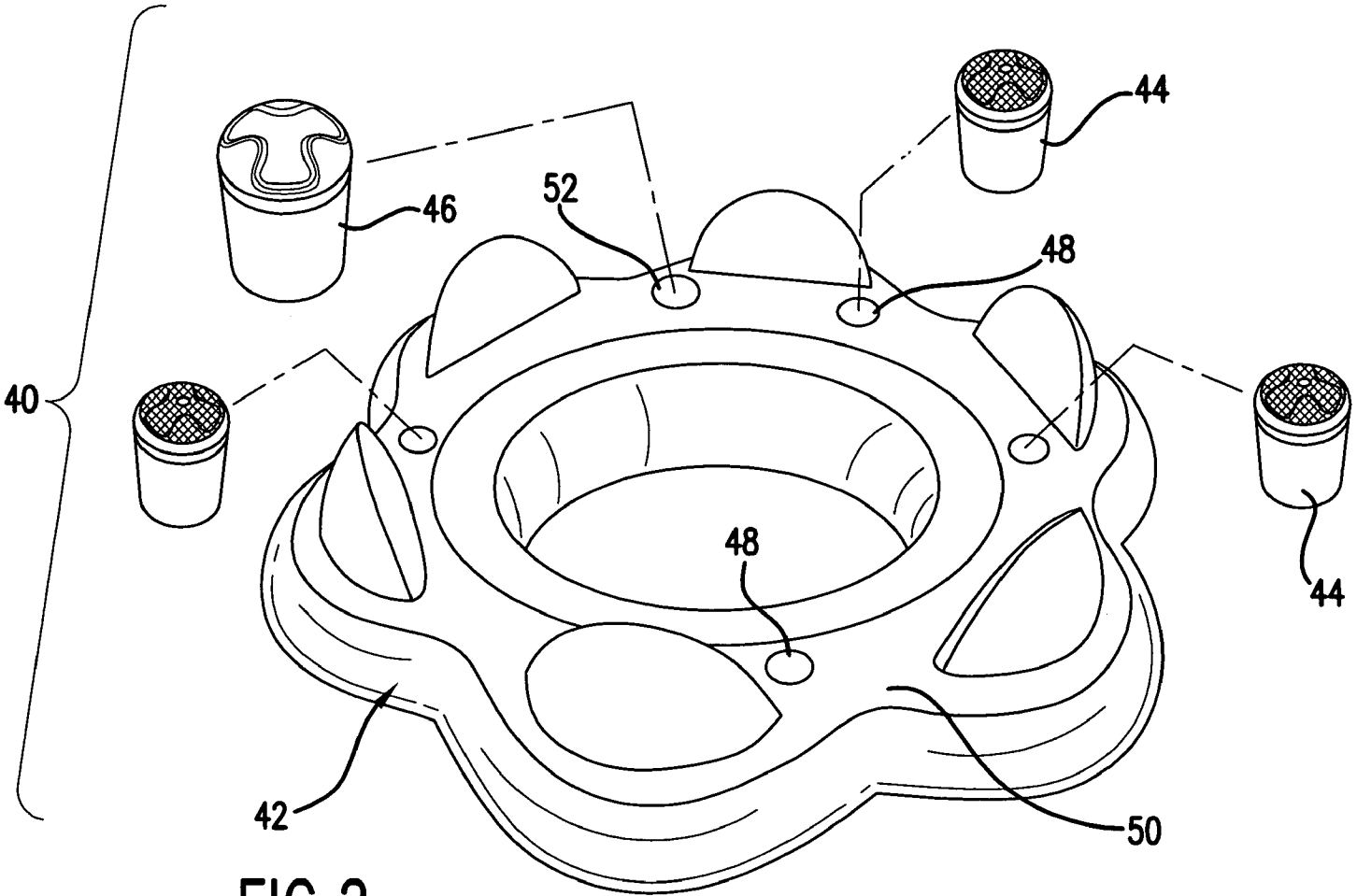
FIG. 2 is an perspective view of a floating assembly that incorporates electronic devices according to the present invention.

FIG. 2 illustrates a floating assembly 40 according to another embodiment of the present invention. The assembly 40 includes a floating device 42, one or more speaker units 44, and an MP3 battery box 46. The floating device 42 can be the same as any conventional inflatable floating device or floating ring that is available in the marketplace, and includes cavities 48 provided in the body 50 for receiving respective speaker units 44, and another cavity 52 in the body 50 for receiving the MP3 battery box 46. The speaker units 44 and the MP3 battery box 46 are secured to the cavities 48, 52 in the manner described below.

Figure 3:
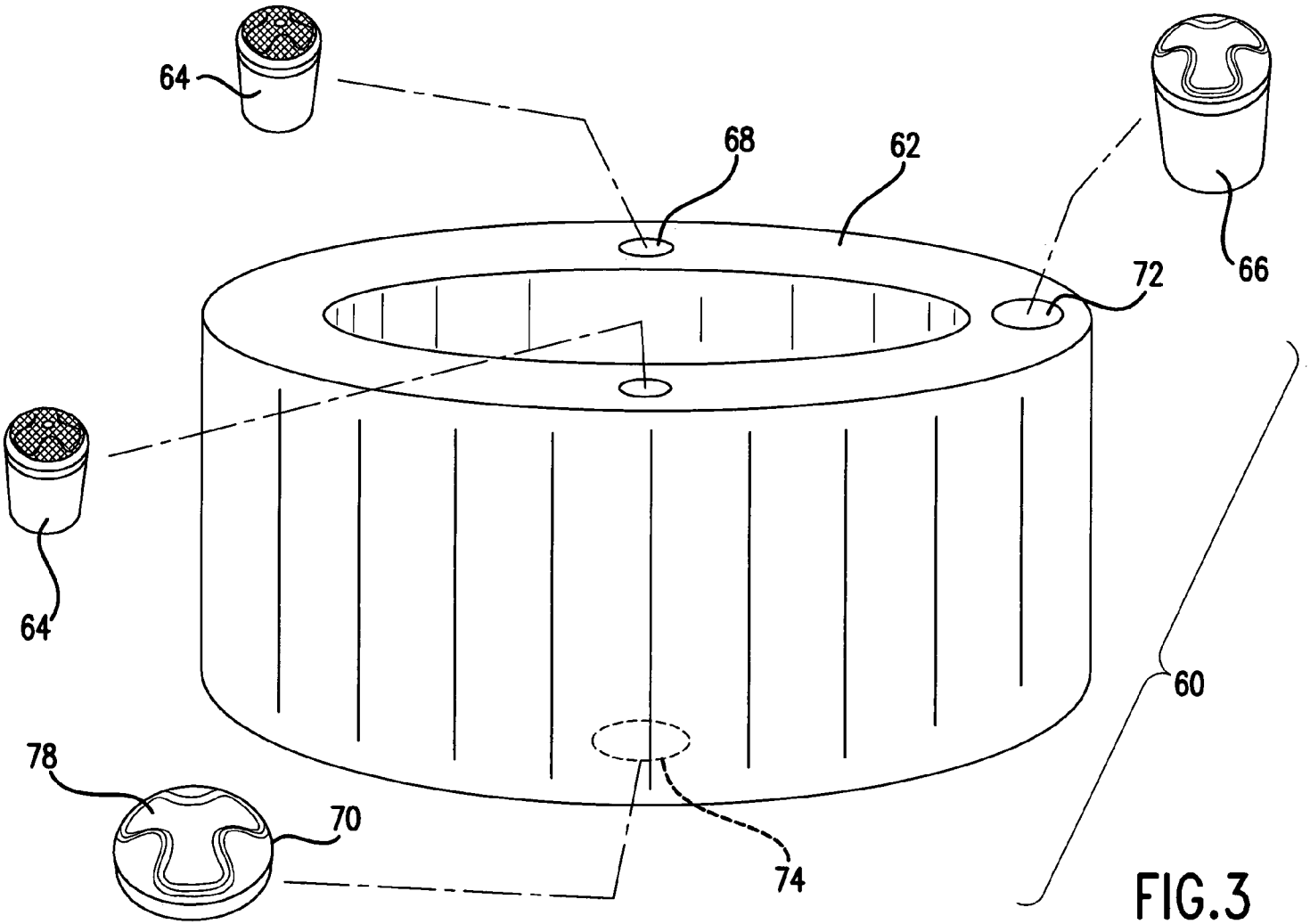
FIG. 3 is an perspective view of a jacuzzi assembly that incorporates electronic devices according to the present invention.

FIG. 3 illustrates a jacuzzi assembly 60 according to yet another embodiment of the present invention. The assembly 60 includes a jacuzzi sidewall 62, one or more speaker units 64, an MP3 battery box 66, and a lighting device 70. The jacuzzi sidewall 62 can be the same as any conventional jacuzzi that is available in the marketplace, and includes cavities 68 provided in the top of the sidewall 62 for receiving respective speaker units 64, and another cavity 72 in the top of the sidewall 62 for receiving the MP3 battery box 66. The speaker units 64 and the MP3 battery box 66 are secured to the cavities 68, 72 in the manner described below. In addition, the lighting device 70 can be secured in a cavity 74 provided in an inner wall of the jacuzzi using the techniques described below.

Figure 4:
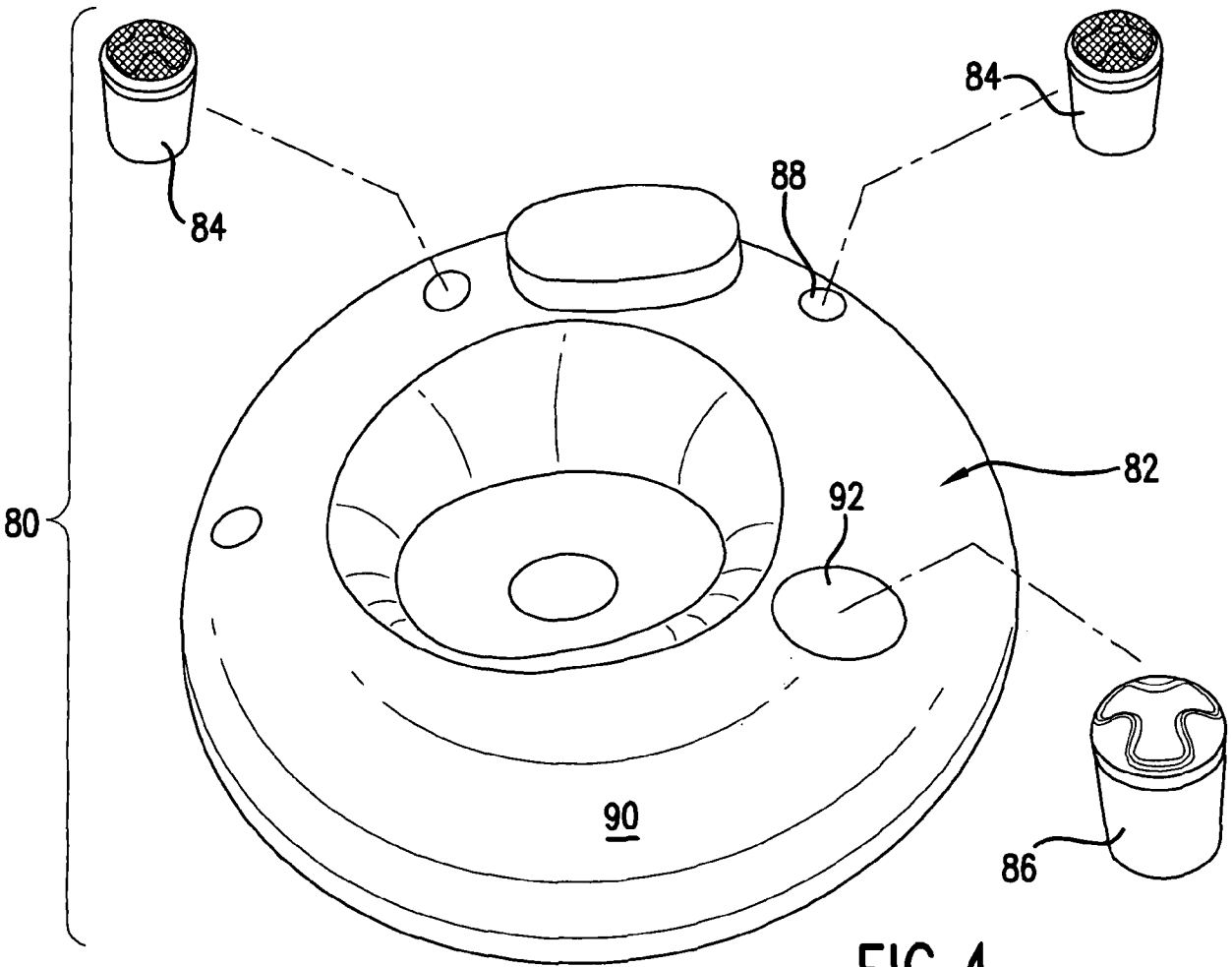
FIG. 4 is an perspective view of a floating music bag assembly that incorporates electronic devices according to the present invention.

FIG. 4 illustrates a floating assembly 80 according to another embodiment of the present invention. The assembly 80 includes a floating ring 82, one or more speaker units 84, and an MP3 battery box 86. The floating ring 82 can be the same as any conventional inflatable floating ring that is available in the marketplace, and includes cavities 88 provided in the body 90 for receiving respective speaker units 84, and another cavity 92 in the body 90 for receiving the MP3 battery box 86. The speaker units 84 and the MP3 battery box 86 are secured to the cavities 88, 92 in the manner described below.

Figure 5:
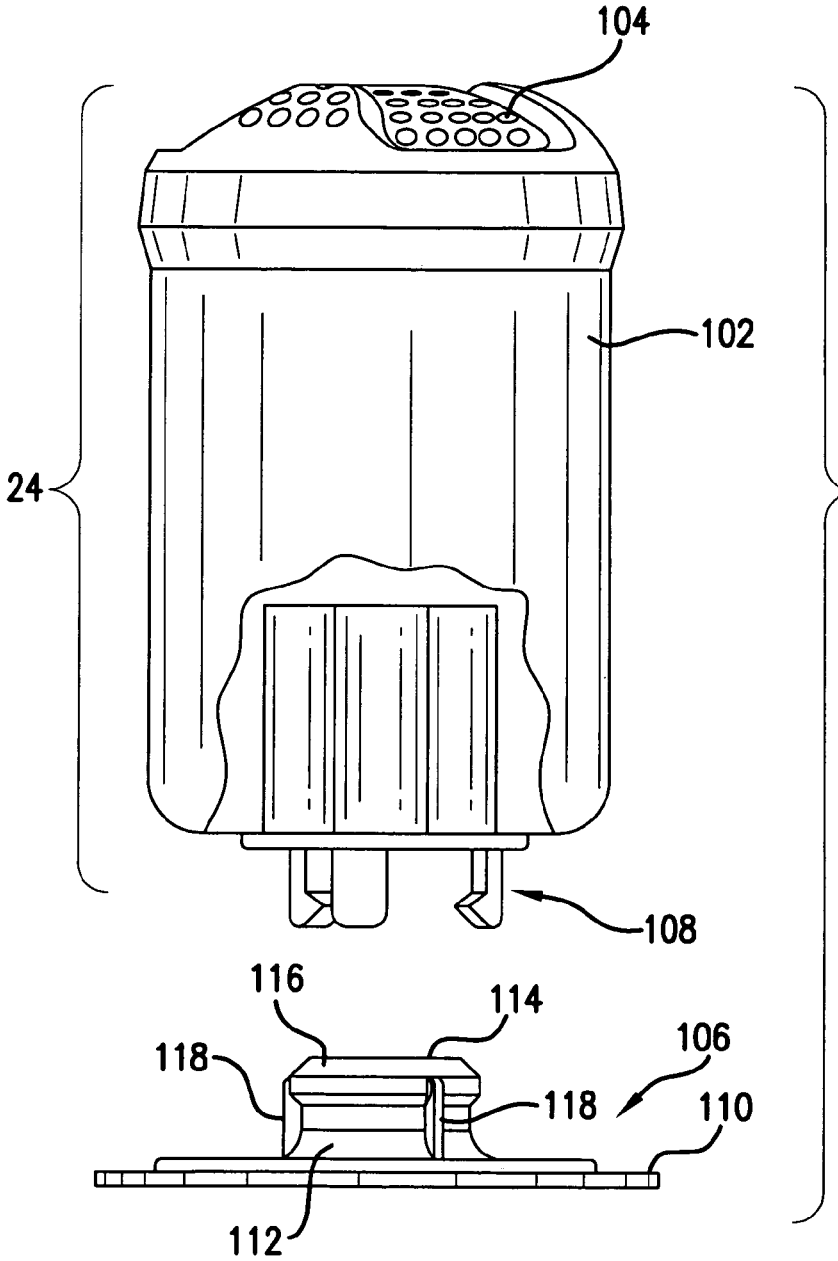
FIG. 5 is an exploded side view of a speaker unit with the latching assembly of the present invention.

FIG. 5 illustrates a speaker unit 24, with the other speaker units 44, 64 and 84 having the same construction. The speaker unit 24 has a speaker housing 102 that houses the internal components and circuitry of a conventional speaker, and a speaker section 104 at the top of the housing 102 where sounds are broadcast. The housing 102 is preferably made of a waterproof material such as plastic, ABD or PP.

Figure 6:
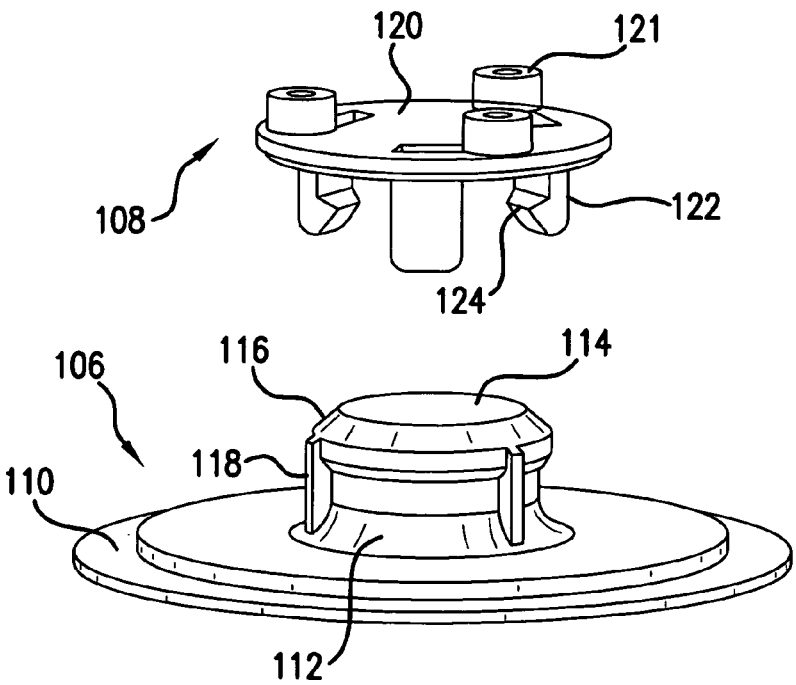
FIG. 6 is an exploded perspective view of the latching assembly of the present invention.
Figure 7:
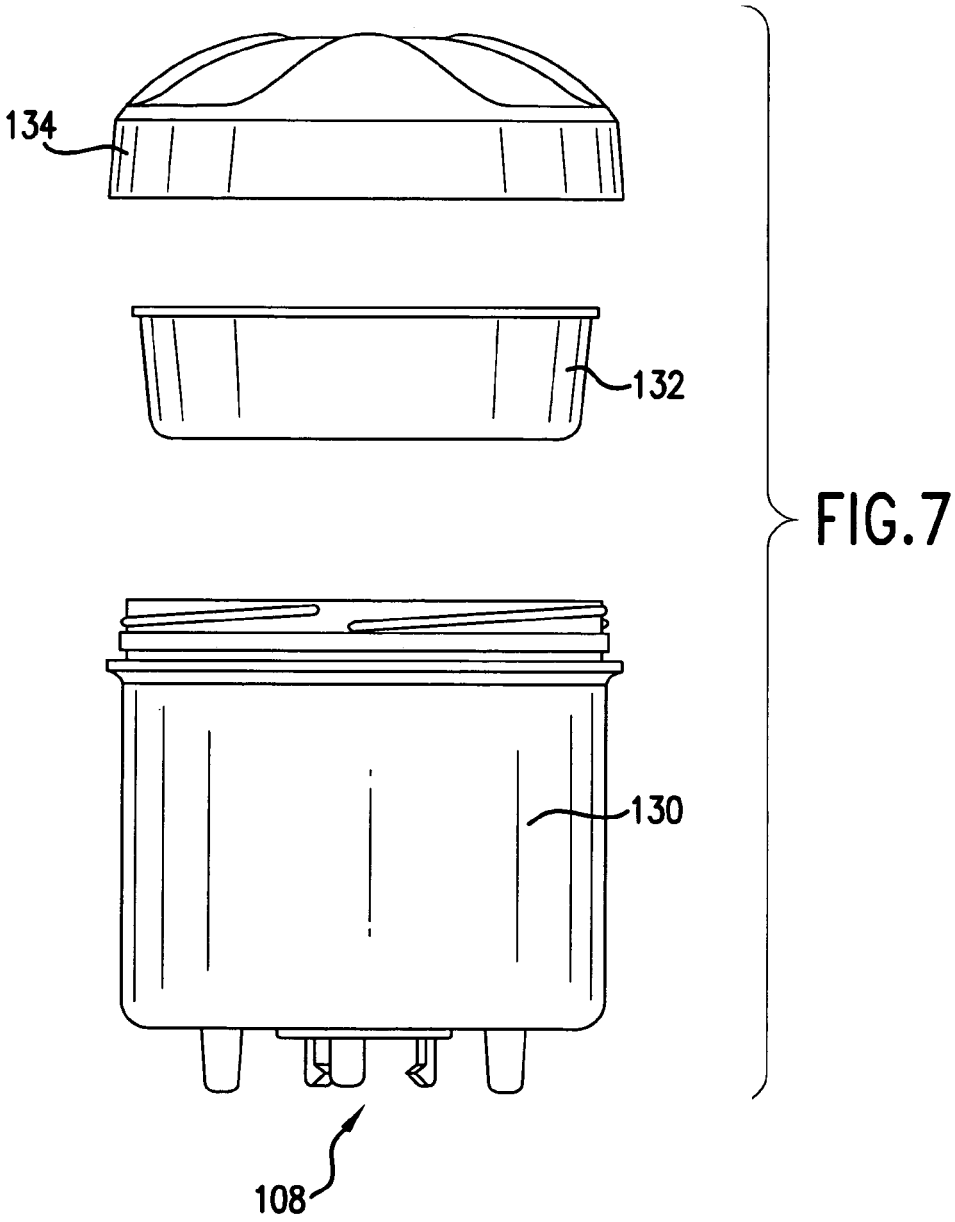
FIG. 7 is an exploded side view of an MP3 battery box of the present invention.
Figure 10:
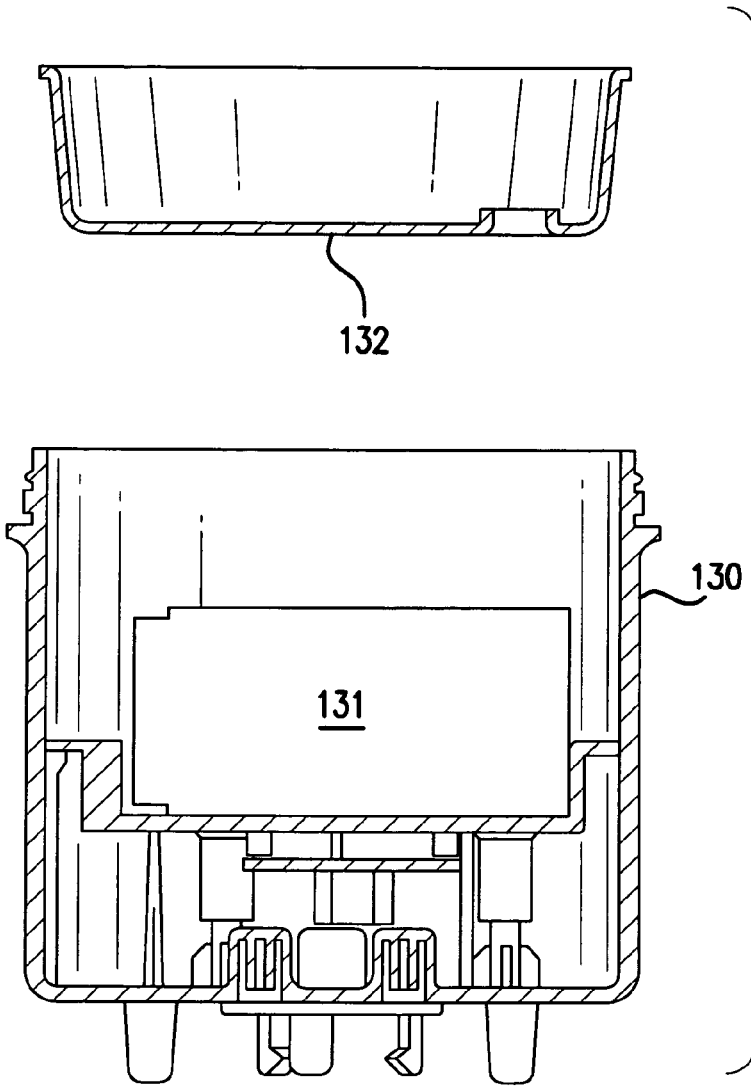
FIG. 10 is an exploded cross-sectional view of the MP3 battery box of FIG. 7.

Referring also to FIG. 6, a latching assembly that includes a base latch 106 and a device latch 108 is provided to secure the speaker unit 24 inside the appropriate cavity 28, 48, 68, 88 to that the speaker unit 24 does not become disengaged and contact water. In particular, the base latch 106 has a base portion 110 that is permanently attached (e.g., by ultrasonic welding) to the wall of the body (e.g., 30, 50, 62 and 90) of the inflatable device 22, 42, 62 or 82. The base latch 106 further includes a central shaft portion 112 that extends upwardly from the base portion 110, and a flat top cap 114 that is greater in diameter than the shaft portion 112 so that an annular flange 116 extends around the top of the shaft portion 112. A plurality of vertical ribs 118 extend from the base portion 110 along the annular wall of the shaft portion 112 to the flange 116. The ribs 118 function to prevent the speaker unit or the battery box from freely rotating about the connection between the base latch 106 and the device latch 108, because the rotation may damage the connecting plugs and wires of the speaker unit and battery box. The three ribs 118 limit the rotation of the speaker unit and the battery box to a maximum of 120 degrees. The device latch 108 has a flat generally circular panel 120 that is mounted by three screws (via screw holders 121) to the bottom of the speaker housing 102, and a plurality of flexible legs 122 extending in spaced-apart manner about the annular edge of the panel 120. Each leg 122 has an inwardly-facing hook portion 124. In use, the device latch 108 is pressed against the top cap 114 of the base latch 106 until the legs 122 are flexed and the hook portions 124 secured below the flange 116. This secures the device latch 108 (and its speaker unit 24) to the base latch 106. The latches 106, 108 are disengaged by gripping the speaker housing 102 with one hand and then pulling it upwardly, causing the legs 122 to flex and pass around the flange 116.

Figure 8:
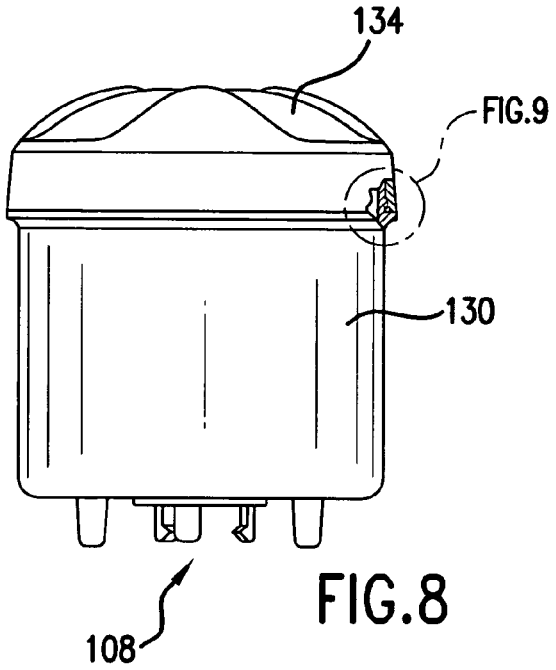
FIG. 8 is a side plan view of the MP3 battery box of FIG. 7.
Figure 9:
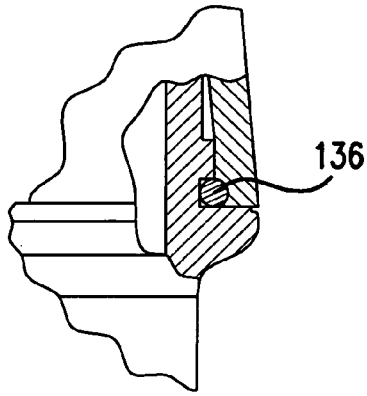
FIG. 9 is an enlarged view of the area indicated by the circle A in FIG. 8.

FIGS. 7-10 illustrate an MP3 battery box 26, with the other MP3 battery boxes 46, 66 and 86 having the same construction. The MP3 battery box 26 has a battery housing 130 that houses a battery 131 and associated circuitry and components, an MP3 container portion 132 which is like a removable tray that holds an MP3 player (not shown), and a top cap 134. The MP3 container portion 132 is positioned inside the battery housing 130 above the battery 131, with top cap 134 positioned above the battery housing 130 to seal the battery housing 130. As shown in FIG. 8, a silicon O-ring 136 can be provided between the top cap 134 and the housing 130 to further prevent leakage of water into the interior of the MP3 battery box 26. The housing 130 is preferably made of a waterproof material such as plastic, ABS or PP. The MP3 container portion 132 can be used to hold small items such as an MP3 player, an IPOD, a cell phone, or a repair kit in a waterproof environment.

Referring to FIG. 3, the lighting device 70 has a housing that houses a light-emitting element 78 (e.g., a light bulb, LEDs, or LCDs) and associated circuitry and wiring. The latching assembly of FIG. 6 can be provided to secure the lighting device 70 to a cavity 74.

Figure 11:
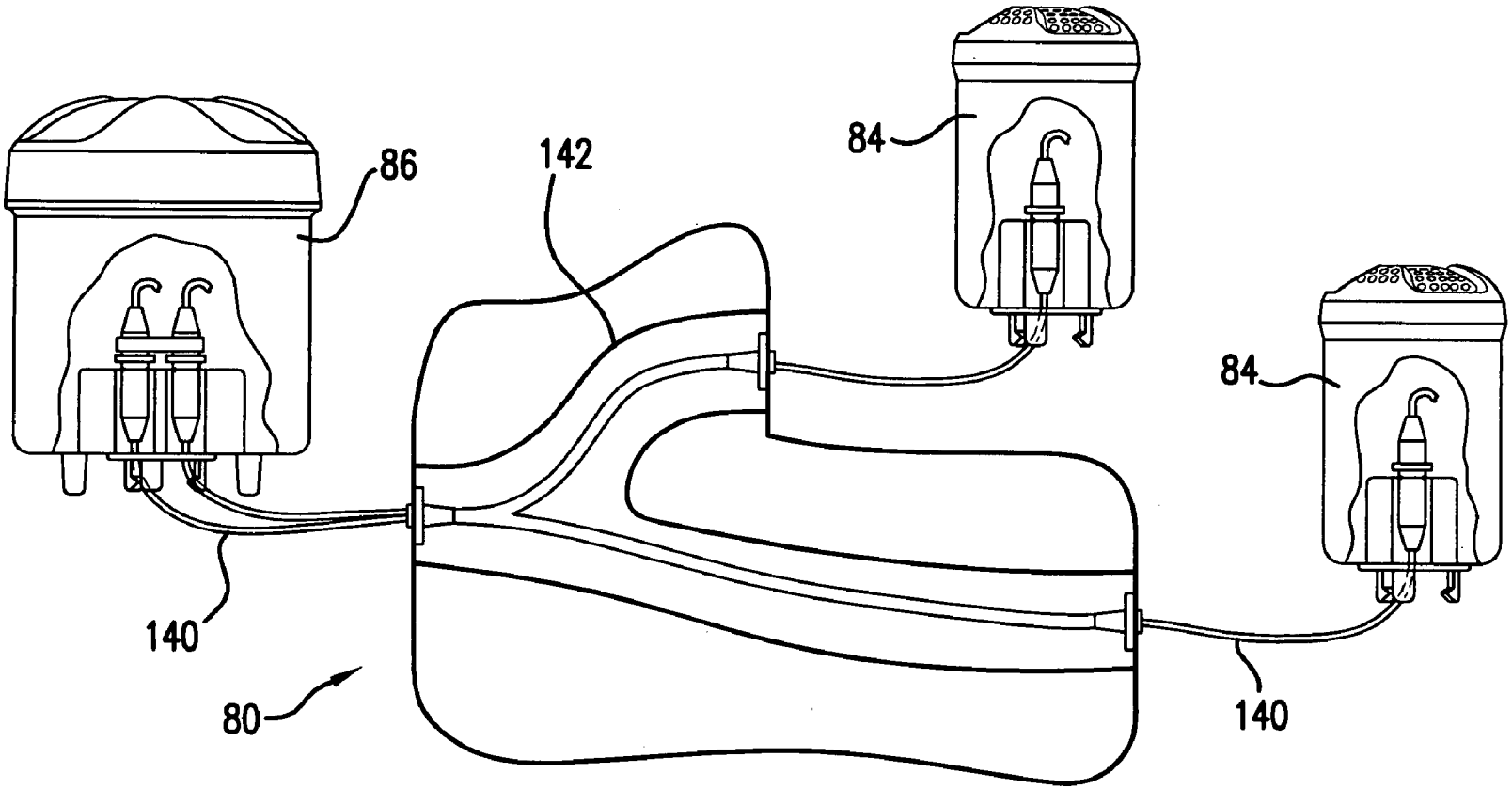
FIG. 11 illustrates the connections between the MP3 battery box and the speaker units.
Figure 12:
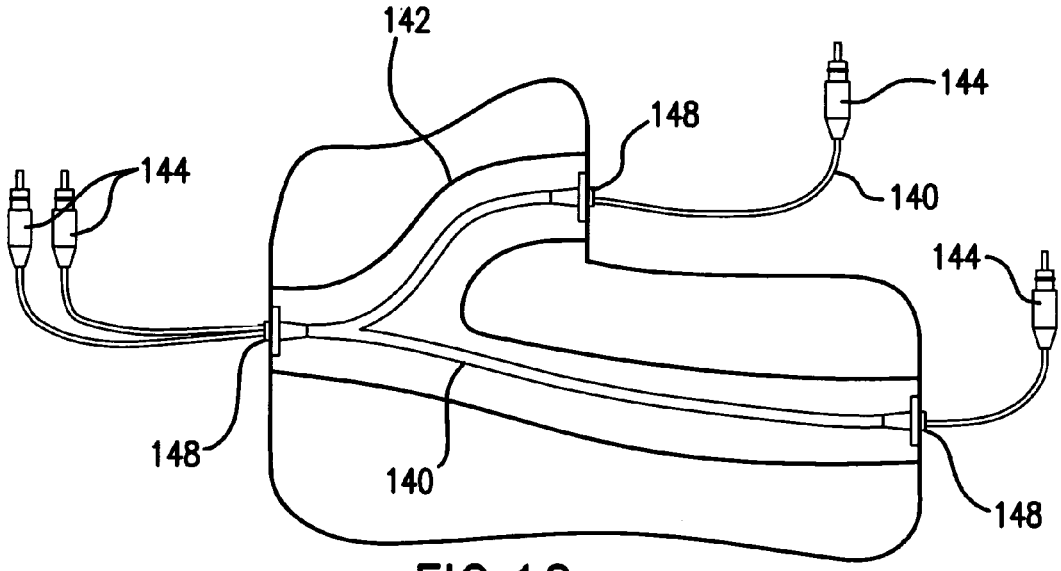
FIG. 12 is an enlarged view of the wiring of FIG. 11.

Referring now to FIGS. 11-12, the MP3 battery box 86 can be electrically connected to the speaker units 84 by wires 140 that extend inside the body 90 of the assembly 80. In particular, each inflatable device (such as a floating ring) is made up of a body (such as 90) that has a hollow interior is that adapted to be filled by air when inflated. The wires 140 extend through the hollow interior of the body 90, and can be used to deliver electrical signals and power between the speaker units 84 and the MP3 battery box 86. The wires 140 are covered by PVC™ tubes 142 that also extend in the hollow interior of the body 90. A plug 144 (i.e., an electrical connector) is provided at the opposite ends of each wire 140, with each plug 144 adapted to be removably connected with a corresponding jack 146 (i.e., another electrical connector; see FIGS. 13-15) that is provided at either the speaker unit 84 or the MP3 battery box 86. An exit flange 148 (see FIGS. 11-12) of a stereo plug can be ultrasonically welded on the PVC™ tube 142 to the material of the body 90 at the locations where the wires 140 and their PVC™ tube 142 exit the hollow interior of the body 90. The use of the PVC™ tube 142 to retain the wires 140 minimizes air leaks. Specifically, the locations (i.e., where the flanges 148 are located) where the wires 140 exit the interior of the body 90 are where air is most likely to escape from the interior of the body 90. By providing the wires 140 inside the tube 142, and by sealing the tube 142 at the exit locations via use of the flanges 148, air from inside the body 90 will have to go through a complicated path to escape. For example, the air would have to penetrate the tube 142, and then escape from inside the tube 142 via the flange 148. In contrast, if the tube 142 were omitted, and the wires 140 made to exit directly from the flanges 148, then the air can escape directly via the exit locations. Thus, the provision and arrangement of the tubes 142 further minimizes air leaks.

Figure 13:
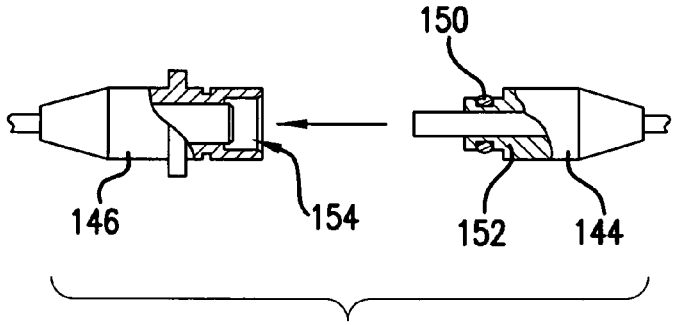
FIG. 13 is an exploded cross-sectional view of a plug and a jack according to the present invention.
Figure 14:
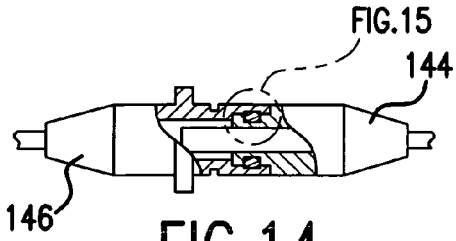
FIG. 14 is a cross-sectional view showing the plug and jack of FIG. 13 connected together.
Figure 15:
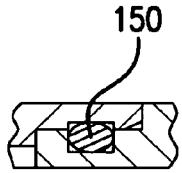
FIG. 15 is an enlarged view of the area B shown in FIG. 14.

In addition, referring to FIGS. 13-15, a silicone O-ring 150 can be provided on an extension 152 of the plug 144 which is to be inserted into the bore 154 of the jack 146 to further water-proof this connection between the plugs 144 and the jacks 146.

Even though FIG. 11 illustrates the electrical connections in connection with the assembly 80 of FIG. 4. the same principles can be applied to the assemblies 20, 40 and 60 in FIGS. 1-3. For jacuzzis in FIG. 3 that do not have inflatable walls, then the tubes 142 are not needed and can be omitted.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. An inflatable device that floats on water, the device comprising:

an inflatable body having a hollow interior;

a speaker unit removably secured to the body;

a battery box removably secured to the body;

wiring that electrically connects the speaker unit with the battery box, the wiring housed inside a tube that extends inside the hollow interior of the body and where the wiring exits the body at least one exit location, the wiring including a first electrical connector that is removably coupled to the speaker unit, and a second electrical connector that is removably coupled to the battery box; and wherein the battery box is removably secured in a second cavity in the body by a latching assembly that includes a base latch permanently secured inside the second cavity and a device latch that is permanently secured to the battery box.

2. The device of claim 1, further including a battery stored inside the battery box.

3. An inflatable device that floats on water, the device comprising:

an inflatable body having a hollow interior;

a speaker unit removably secured to the body;

a battery box removably secured to the body;

wiring that electrically connects the speaker unit with the battery box, the wiring housed inside a tube that extends inside the hollow interior of the body and where the wiring exits the body at least one exit location, the wiring including a first electrical connector that is removably coupled to the speaker unit, and a second electrical connector that is removably coupled to the battery box; and wherein the speaker unit is removably secured to a first cavity in the body by a latching assembly that includes a base latch permanently secured inside the first cavity and a device latch that is permanently secured to the speaker unit.

4. The device of claim 3, wherein:

a. the base latch has a base portion that is permanently attached to the body of the inflatable device, a central shaft portion that extends upwardly from the base portion, and a flat top cap that is greater in diameter than the shaft portion so as to define an annular flange extending around the top of the shaft portion; and b. the device latch has a flat generally circular panel that is permanently attached to the bottom of the speaker housing, and a plurality of flexible legs extending in spaced-apart manner about the annular edge of the panel, with each leg having an inwardly-facing hook portion.

5. The device of claim 1, wherein the base latch further includes a plurality of vertical ribs that extend from the base portion along the annular wall of the shaft portion to the flange.

6. An inflatable device that floats on water, the device comprising:

an inflatable body having a hollow interior;

a speaker unit removably secured to the body;

a battery box removably secured to the body;

wiring that electrically connects the speaker unit with the battery box, the wiring housed inside a tube that extends inside the hollow interior of the body and where the wiring exits the body at least one exit location, the wiring including a first electrical connector that is removably coupled to the speaker unit, and a second electrical connector that is removably coupled to the battery box; and wherein the first and second electrical connectors are plugs that have an O-ring provided along an extension, the speaker unit and the battery box each having a jack with a bore into which a corresponding extension and its O-ring are inserted.

7. An inflatable device that floats on water, the device comprising:

an inflatable body having a hollow interior;

a speaker unit removably secured to the body;

a battery box removably secured to the body, and having a battery stored therein;

wiring that electrically connects the speaker unit with the battery box, the wiring housed inside a tube that extends inside the hollow interior of the body and where the wiring exits the body at least one exit location, the wiring including a first electrical connector that is removably coupled to the speaker unit, and a second electrical connector that is removably coupled to the battery box; and wherein the battery box has a housing that holds the battery, a removable tray that is seated inside the housing, and a top cap that covers the tray and the housing, with an O-ring positioned between the housing of the battery box and the top cap.

8. The device of claim 1, further including a lighting device removably secured in a cavity in the body and electrically coupled to the battery box.

9. The device of claim 1, wherein the inflatable device is a pool float.

10. The device of claim 1, wherein the inflatable device is a jacuzzi.

11. The device of claim 1, further including an exit flange secured at each exit location, with the tube and its wiring extending through the exit flange.

12. An inflatable device that floats on water, the device comprising:

an inflatable body having a hollow interior;

a speaker unit removably secured to the body by a first latching assembly that includes a first base latch permanently secured to the body and a first device latch that is permanently secured to the speaker unit;

a battery box removably secured to the body by a second latching assembly that includes a first base latch permanently secured to the body and a second device latch that is permanently secured to the battery box;

wiring that electrically connects the speaker unit with the battery box, the wiring housed inside a tube that extends inside the hollow interior of the body and where the wiring exits the body at least one exit location, the wiring including a first electrical connector that is removably coupled to the speaker unit, and a second electrical connector that is removably coupled to the battery box;

an exit flange secured at each exit location, with the tube and its wiring extending through the exit flange; and wherein:

a. the base latch has a base portion that is permanently attached to the body of the inflatable device, a central shaft portion that extends upwardly from the base portion, and a flat top cap that is greater in diameter than the shaft portion so as to define an annular flange extending around the top of the shaft portion; and b. the device latch has a flat generally circular panel that is permanently attached to the bottom of the speaker housing, and a plurality of flexible legs extending in spaced-apart manner about the annular edge of the panel, with each leg having an inwardly-facing hook portion.

13. The device of claim 12, further including a battery stored inside the battery box.

14. The device of claim 12, wherein the first and second electrical connectors are plugs that have an O-ring provided along an extension, the speaker unit and the battery box each having a jack with a bore into which a corresponding extension and its O-ring are inserted.

15. The device of claim 12 wherein the battery box has a housing that holds the battery, a removable tray that is seated inside the housing, and a top cap that covers the tray and the housing, with an O-ring positioned between the housing of the battery box and the top cap.

16. The device of claim 12, further including a lighting device removably secured to the body and electrically coupled to the battery box.

17. The device of claim 12, wherein the inflatable device is a pool float.

18. The device of claim 12, wherein the inflatable device is a jacuzzi.

19. The device of claim 3, further including a lighting device removably secured in a cavity in the body and electrically coupled to the battery box.

20. The device of claim 6, further including a lighting device removably secured in a cavity in the body and electrically coupled to the battery box.

* * * * *